United States Patent [19]

Merrill et al.

[11] Patent Number: 5,035,838

[45] Date of Patent: Jul. 30, 1991

[54] NONIONIC SURFACTANT BASED LIQUID DETERGENT FORMULATION CONTAINING AN ALKENYL OR ALKYL CARBOXYSULFONATE COMPONENT

[75] Inventors: Connie L. Merrill, Katy; Donald L. Wood, Houston, both of Tex.

[73] Assignee: Shell Oil Company, Houston, Tex.

[21] Appl. No.: 426,148

[22] Filed: Oct. 24, 1989

[51] Int. Cl.[5] ..... C11D 1/18; C11D 3/065; C11D 3/30

[52] U.S. Cl. ..... 252/545; 252/174.21; 252/526; 252/554; 252/557; 252/DIG. 1; 252/DIG. 14

[58] Field of Search ..... 252/526, 53, 545, 557, 252/DIG. 14, 173, 153, 174.21, 554, DIG. 1

[56] References Cited

U.S. PATENT DOCUMENTS

| | | | |
|---|---|---|---|
| 3,732,290 | 9/1975 | Danzik | 260/507 R |
| 3,793,226 | 2/1974 | Danzik | 252/526 |
| 3,869,412 | 3/1975 | Waag | 252/527 |
| 3,903,138 | 9/1975 | Danzik | 260/485 J |
| 4,790,856 | 12/1988 | Wixon | 8/137 |

OTHER PUBLICATIONS

Katstra, R. D. et al., "Controlled Foam Laundry Formulations", *J.A.O.C.S.*, vol. 49, Jan. 1972, pp. 38–43.

*Primary Examiner*—Paul Lieberman
*Assistant Examiner*—Alexander G. Ghyka

[57] ABSTRACT

A nonionic surfactant based liquid laundry detergent formulation which consists essentially of between about 20 and about 30 percent by weight of one or more nonionic surfactants, between about 1 and 10 percent by weight of one or more of certain carboxysulfonate compounds which may be prepared, for example, by the direct reaction of a hydrocarbyl succinic anhydride with either an aminoalkyl sulfonate or a salt of isethionic acid, between about 2 and about 20 percent by weight of detergent builder, between about 2 and about 8 percent by weight of triethanol amine, and water. The formulation is very effective for removal of both particulate and oily soils from fabrics and for preventing their redeposition onto the fabrics during the wash. The formulations are further characterized as low-foaming and relatively insensitive to water hardness. The several components are highly compatible and can be formulated into stable, single-phase compositions, without the need for added hydrotropes and/or solubilizers.

21 Claims, No Drawings

NONIONIC SURFACTANT BASED LIQUID DETERGENT FORMULATION CONTAINING AN ALKENYL OR ALKYL CARBOXYSULFONATE COMPONENT

FIELD OF THE INVENTION

The present invention relates to a nonionic surfactant based liquid laundry detergent formulation, and more particularly to a biodegradable, low-foaming formulation consisting essentially of one or more nonionic surfactants, one or more of certain carboxysulfonate compounds, triethanol amine, and water.

SUMMARY OF THE INVENTION

The present invention provides a nonionic surfactant based, stable single-phase, built, biodegradable, low-foaming liquid laundry detergent formulation which consists essentially of (a) between about 20 and about 30 percent by weight of one or more nonionic surfactants selected from the group consisting of alcohol ethoxylate surfactants and alkyl-substituted phenol ethoxylate surfactants having an average of between about 4 and about 12 ethylene oxide units per ethoxylate molecule, (b) between about 1 and about 10 percent by weight of one or more carboxysulfonate compounds of the formula $$\mathrm{XOOC-\overset{(R^1)_p}{\overset{|}{C}H(H)_q-\overset{(R^1)_q}{\overset{|}{C}H(H)_p-\overset{O}{\overset{\|}{C}}}}-Z-CH_2-CH_2-SO3M,} \qquad \text{(I)}$$

wherein $R^1$ is selected from the groups consisting of alkenyl and alkyl groups having carbon numbers in the range of from about 9 to 18, p is either 0 or 1, q is 0 when p is 1 and q is 1 when p is 0, X is either a hydrogen atom or is M, Z represents either an oxygen atom, a sulfur atom or the amide group —N($R^2$(—wherein $R^2$ is lower hydrocarbyl, particularly $C_1$ to $C_4$ alkyl, and each M is a salt forming cation, preferably an alkali metal or ammonium cation, with the further provision that the sum of components (a) and (b) is between about 21 and about 35 percent by weight, (c) between 0 and 20 percent by weight of a detergent builder, (d) between about 2 and about 8 percent by weight of triethanol amine, and (e) water.

The formulation is very effective for removal of both particulate and oily soils from fabrics and for preventing their re-deposition onto the fabrics during the wash. It is further tolerant of hard water wash conditions. The alkenyl or alkyl carboxysulfonate ("ACS") compounds serve as multi-functional components in the formulation. Functioning as anionic surfactant, the presence of the ACS compounds aids in the removal of particulate and polar soils. Unlike the anionic surfactants which have been commonly formulated into conventional nonionic based formulations, the ACS surfactant component of this invention generates relatively little foam in aqueous wash solutions, a property which is very desirable in laundry applications. The ACS component further aids in sequestering $Ca^{+2}$ and $Mg^{+2}$ ions in water, providing a formulation which is tolerant to hard water wash applications. Still further, the ACS component acts as an "anti-redeposition" agent, facilitating the suspension of soil particles in the washwater and their effective separation from laundry fabrics. In addition, the ACS compounds are highly compatible with the nonionic surfactants in aqueous solutions/dispersions, permitting formulation of the two types of surfactants into a stable, single-phase composition, without the need for added hydrotropes and/or solubilizers as are often required for the effective blending of anionic and nonionic surfactants in liquid concentrates. These several functions of the ACS compounds provide a simplified but very effective formulation in terms of both its detergent performance and physical properties.

DETAILED DESCRIPTION OF THE INVENTION

The nonionic surfactant component of the invention is suitably made up of one or more ethylene oxide adducts (i.e., "ethoxylates") of alcohols or alkyl-substituted phenols, and can be represented by the formula $RO-(CH_2CH_2O)_n-H$, wherein the RO group corresponds to the starting alcohol or alkyl-substituted phenol (in each case less its active hydrogen atom). In general, the alcohol ethoxylates are preferably derived from alcohols, particularly alkanols, in the carbon number range from about 9 to 16, while preferred alkylphenol ethoxylates are derived from those having alkyl substituents in the carbon number range from about 8 to 12. Both the alcohol ethoxylates and the alkYl-phenol ethoxylates are nonionic surfactants well known as components of commercial liquid laundry detergent formulations.

With regard to the use of alkanol ethoxylate surfactants, the individual compounds are more preferably characterized by an alkyl R group in the carbon number range from about 11 to 15. Both primary and secondary alkanol ethoxylates (having primary or secondary alkyl R groups, respectively) are suitable in the invention. The R group is suitably linear or branched.

The alkyl-substituted phenol ethoxylate compounds more preferably have an alkyl substituent with between about 8 and about 11 carbon atoms. The alkyl substituent may be either branched or linear.

Suitable nonionic ethoxylate surfactants contain an average number of ethylene oxide units (i.e., an average value of n in the above formula) which is in the range from about 4 to 12 per molecule. Preferably, the ethoxylate surfactants contain an average number of ethylene oxide units which is in the range from about 5 to 10 per molecule, with between about 5 and 9 ethylene oxide units being particularly preferred for the alcohol ethoxylates and between about 6 and 10 ethylene oxide units being particularly preferred for the alkyl phenol ethoxylates.

The carboxysulfonate ACS component suitable for the formulation of the invention contains one or more compounds of the formula $$\mathrm{XOOC-\overset{(R^1)_p}{\overset{|}{C}H(H)_q-\overset{(R^1)_q}{\overset{|}{C}H(H)_p-\overset{O}{\overset{\|}{C}}}}-Z-CH_2-CH_2-SO_3M,} \qquad \text{(I)}$$

wherein $R^1$ represents an alkyl or alkenyl group having a carbon number in the range of from about 9 to about 18. The compound has only one $R^1$ substituent, reflected by the requirement that either p or q in the formula is 1 while the other is 0. A mixture of both the p=1, q=0 and the p=0, q=1 compounds is formed when the ACS compounds are prepared by conventional methods. X represents either a hydrogen atom or an M substituent, Z represents an oxygen atom, a sulfur atom or the amide group —N($R^2$)—wherein $R^2$ is lower hydrocarbyl, particularly $C_1$ to $C_4$ alkyl, and each M is a salt forming cation, preferably an alkali metal or ammonium cation. When the Z substituent is a —N($R^2$)- group, the $R^2$ moiety is most preferably methyl. The group $R^1$ preferably has a carbon number in the range from about 12 to about 18, more preferably a carbon number in the range from about 12 to about 16, and most preferably a carbon number of about 14. The Z substituent is preferably an oxygen atom or an amide group.

For enhanced biodegradability of the detergent formulation, it is preferred that the alkyl group R of the the alcohol ethoxylates, the alkyl substituent of the alkyl-substituted phenols, and the alkenyl or alkyl group $R^1$ of the ACS molecule all be of predominantly linear carbon chain structure. In this respect, it is particularly preferred that the surfactant molecules be essentially free of alkyl or alkenyl groups having multiple branches in the carbon chain, such as result, for instance, from synthesis via the oligomerization of lower olefins such as propylene and the butylenes.

The formulation of the invention comprises between about 20 and about 30 percent by weight (% w) of the nonionic surfactant component and between about 1 and about 10% w of the ACS component. Formulations containing between about 23 and about 28% w of the nonionic surfactant and between about 2 and about 8% w of the ACS component are preferred. Preferably, the nonionic surfactant component and the ACS component together total between about 25 and about 35 percent by weight.

Also present in the formulation is a triethanolamine component which functions principally as a pH buffer, to maintain pH of a wash water solution of the formulation in the range of about 7.5 to about 10. The triethanol amine component is present in the formulation in a quantity between about 2 and about 8% w, more preferably in a quantity between about 3 and about 7% w.

The only other necessary component of the formulation of the invention is water. In general, water is present in an amount between about 57 and about 73% w.

The formulation can, if desired, contain a detergent builder component. Builders are included in detergent formulations to enhance their cleaning performance by softening water and providing alkalinity and buffering capacity to the wash. This builder component must be an organic compound soluble in the formulation, and is preferably one selected from the group consisting of polycarboxylates such as ethylenediamine tetraacetate, nitrilo triacetate, and citrate, maleic, acrylic and methacrylic polymers. The builder may be present in an amount up to about 20 percent by weight. When such a builder is used, it is preferably present in the formulation in an amount between about 5 and 15 percent by weight.

In addition to its four principal components and the optional builder, the formulation of the invention may suitably contain minor amounts of other components known in the art for use in such products (e.g., dyes, fragrances, bleaches, bleach activators, enzymes, etc.). The formulation does not require materials such as added hydrotropes or solubilizers to facilitate the blending of the components into a stable single-phase liquid composition. It is considered to be a particular advantage of the present invention that it can be formulated into a stable single-phase liquid in the absence of hydrotropes, solubilizers and the like (for instance, ethanol, aromatic sulfonates, alcohol ethoxyphosphates, alkylphenol ethoxyphosphates, etc.) which are necessary to the blending of many conventional liquid detergent products.

The ACS amide compounds and their preparation have been described by M. Danzik in U.S. Pat. Nos. 3,793,226 and No. 3,732,290. These patents are directed to a class of "monoamide hydrocarbyl sulfonic acid salts of hydrocarbyl succinic acid", including ACS compounds of formula I wherein Z is a —N($R^2$)—group and $R^2$ is alkyl. These compounds were prepared by the direct reaction of a hydrocarbyl succinic anhydride with an aminohydrocarbyl sulfonic acid salt. Stoichiometric quantities of the anhydride and the amino sulfonic acid salt, were contacted under neutral or basic conditions at temperatures in the range of 100 to 220° C. The procedures of Danzik can be followed for the preparation of the compounds of the invention, using an alkenylsuccinic anhydride wherein the alkenyl radical corresponds to the $R^1$ substituent in the above formula and a salt of an alkyl amino sulfonic acid such as N-methyltaurine, N-ethyltaurine, etc. It has been found to be preferred to carry out the reaction of alkenylsuccinic anhydride with an equimolar quantity or a small excess (e.g., up to 10% stoichiometric excess, particularly a 2%-5% excess) of the aminohydrocarbyl sulfonic acid salt at a temperature in the range from about 140 to 160° C. The reaction is preferably carried out in a solvent, for instance, xylene or toluene. Preferably, the alkyl substituent $R^2$ in the ACS molecule is in the carbon number range from 1 to about 4. Most preferably, it is methyl.

ACS compounds wherein Z in the above formula represents oxygen have been described by V. R. Gaertner in U.S. Pat. No. 3,086,043 and by M. Danzik and R. House in U.S. Pat. No. 3,903,138. These compounds were prepared by contacting the corresponding alkenyl succinic anhydride with a salt of isethionic acid. This reaction has been found to be preferably conducted with an equimolar quantity or a small excess (e.g., up to a 10% stoichiometric excess, particularly a 2%-5% excess) of the isethionic acid salt at a temperature in the range from about 120 to 140° C. The use of a reaction solvent, for instance, xylene or toluene, is preferred.

In either case, if the reaction is carried to substantially complete conversion, so that the product mixture contains at least about 80% w of the ACS, this mixture is suitable for use directly in the formulation of the invention. The product mixture preferably contains at least about 85% w of ACS and more preferably about 90% w of ACS. Physical separation steps, obvious to those of skill in the art, can be applied for removal of excess reactants from a product mixture to bring its ACS content to the desired level.

The teachings of the Danzik, Danzik et al and Gaertner patents are incorporated herein by this reference, insofar as they are relevant to the preparation of ACS compounds useful in this invention.

When prepared by the reaction of an alkenylsuccinic anhydride, the ACS compounds have an alkenyl $R^1$ substituent. Alkly-substituted ACS compounds can be prepared from alkenyl succinic anhydride compounds which have first undergone hydrogenation of the double bond of the alkenyl group. Hydrogenation can be easily accomplished by, for example, contact with hydrogen (at a partial pressure of 500 psi) in the presence of a 10% palladium-on-carbon catalyst at a temperature of 100° C. The alkyl-substituted ACS compounds are typically more stable when applied with bleach, but otherwise generally exhibit performance characteristics similar to those of the corresponding alkenyl-substituted compounds.

The cited patents of Danzik and Danzik and House identify the ACS compounds as biodegradable synthetic detergents which can be applied without phosphate builders. The prior art patents describe the use of the ACS materials in anionic based detergent formulations. They fail to disclose nonionic surfactant based detergent formulations containing ACS compounds.

Although the Gaertner patent describes the ACS compounds as useful in applications where a high level of foaming or sudsing activity is demanded, it is considered to be of particular advantage that the ACS containing formulations of this invention generate low levels of foam.

The invention is further described with reference to the following examples, which are intended to illustrate certain particularly preferred aspects of the invention, without limiting its broader scope.

EXAMPLES 1-7.

Characterization of ACS compounds derived from an N-methyl taurine salt.

A series of ACS compounds useful in formulating compositions according to the invention were prepared by the addition of the sodium salt of N-methyl taurine to different alkenyl succinic anhydride (ASA) compounds. The ASA compounds were distinguished one from the other by the presence of alkenyl groups of different carbon number, which correspond to different $R^1$ groups (formula I above) in the ACS products. $R^1$ groups were essentially all linear. Duplicate preparations were made of ACS surfactants having $C_{16}$ and $C_{18}$ substituents.

In each case, the compounds were prepared by contact of the ASA compound with a 0 to 3% stoichiometric excess of the sodium salt of N-methyl taurine, added as a dry powder to the melted ASA at elevated temperature, i.e., a temperature sufficient to maintain a mobile fluid, under continuous stirring. All of the materials were obtained in the sodium salt form. Synthesis reaction parameters are presented in the following table.

| Example No. | ASA $R^1$ Group | Reaction Temp. (°C.) | Reaction Time (Min.) |
|---|---|---|---|
| 1 | $C_{12}$ | 176-185 | 85 |
| 2 | $C_{14}$ | 180-191 | 60 |
| 3 | $C_{16}$ | 160-200 | 205 |
| 4 | $C_{16}$ | 155-162 | 225 |
| 5 | $C_{18}$ | 170-195 | 195 |
| 6 | $C_{18}$ | 145-165 | 350 |
| 7 | $C_{22}$-$C_{24}$ | 170-195 | 120 |

Surface tension of each of the ACS products in examples 1-7 was measured for 0.001% w, 0.01% w, 0.1% w, 1.0% w, 5.0% w and 1.0% w solutions in water. For surface tension measurements of the $C_{16}$-substituted ACS products, a mixture of the two products of examples 3 and 4 was tested. For surface tension measurements of the $C_{18}$-substituted ACS products, a mixture of the two products of examples 5 and 6 was tested. Results are presented in the following table. (The $C_{16}$- and $C_{18}$-substituted ACS products alone were not soluble in water at concentrations of 1.0% w or greater.)

| Example No. | Surface Tension (Dynes/cm$^2$) at Concentrations of: 0.001% w | 0.01% w | 0.1% w | 1.0% w | 5.0% w | 10.0% w |
|---|---|---|---|---|---|---|
| 1 | 58 | 32 | 26 | 27 | 30 | 30 |
| 2 | 49 | 30 | 27 | 28 | 30 | 30 |
| 3 + 4 | 36 | 30 | 29 | | | |
| 5 + 6 | 39 | 35 | 33 | | | |

Measurements were also made of critical micelle concentration (cmc) for two of the ACS products in water. Critical micelle concentration is the minimum concentration of the surfactant at which micelles begin to form, and indicates the minimum surfactant concentration necessary for detergency. The product in example 1 showed a critical micelle concentration of 0.03% w, while that in example 2 exhibited a critical micelle concentration of 0.01% w. These results are in the range of cmc values characteristic of nonionic surfactants and much lower than cmc values for common anionic surfactants. (For instance, cmc for a linear $C_{12}$-alkyl substituted benzene sulfonate surfactant was measured as 0.4%.) The low cmc values mean that the ACS products are effective detergents when applied at low concentration in wash water solutions.

EXAMPLES 8-13.

Characterization of ACS compounds derived from an isethionic acid salt.

Another series of ACS compounds useful in formulating compositions according to the invention were prepared by the addition of the sodium salt of isethionic acid to different alkenyl succinic anhydride (ASA) compounds. The ASA compounds were, as in examples 1-7, distinguished one from the other by the presence of alkenyl groups of different carbon number, which correspond to different $R^1$ groups (formula I above) in the ACS products. $R^1$ groups were essentially all linear. Duplicate preparations are shown for ACS surfactants having $C_{16}$ and $C_{18}$ substituents.

In each case, the compounds were prepared by contact of the ASA compound with a 0 to 3% stoichiometric excess of the isethionate (the sodium salt of isethionic acid was added as a dry powder to the melted ASA at elevated temperature, i.e., a temperature sufficient to maintain a mobile fluid) under continuous stirring. All of the ACS materials were obtained in the sodium salt form. Synthesis reaction parameters are presented in the following table.

| Example No. | ASA $R^1$ Group | Reaction Temp. (°C.) | Reaction Time (Min.) |
|---|---|---|---|
| 8 | $C_{12}$ | 122-137 | 65 |
| 9 | $C_{14}$ | 120-135 | 390 |
| 10 | $C_{16}$ | 145-170 | 330 |
| 11 | $C_{16}$ | 135-140 | 360 |
| 12 | $C_{18}$ | 145-188 | 150 |
| 13 | $C_{18}$ | 137-146 | 420 |

$$\mathrm{XOOC{-}\overset{(R^1)_p}{\overset{|}{C}}H(H)_q{-}\overset{(R^1)_q}{\overset{|}{C}}H(H)_p{-}\overset{O}{\overset{\|}{C}}{-}Z{-}CH_2{-}CH_2{-}SO_3M,} \quad (I)$$

Surface tension of each of the ACS products in examples 8-13 were measured for 0.01% w, 0.01% w, 0.1% w, 1.0% w, 5.0% w and 10% w solutions in water. For surface tension measurements of the $C_{16}$-substituted ACS products, a mixture of the two products of examples 10 and 11 was tested. For surface tension measurements of the $C_{18}$-substituted ACS products, a mixture of the two products of examples 12 and 13 was tested. Results are presented in the following table. (The $C_{18}$-substituted product alone was not soluble in water at concentrations of 1.0% w or greater.)

| Example No. | Surface Tension (Dynes/cm$^2$) at Concentrations of: 0.001% w | 0.01% w | 0.1% w | 1.0% w | 5.0% w | 10.0% w |
|---|---|---|---|---|---|---|
| 8 | 65 | 44 | 31 | 34 | 35 | 36 |
| 9 | 44 | 30 | 31 | 33 | 33 | 32 |
| 10 + 11 | 40 | 32 | 32 | 32 | 32 | 32 |
| 12 + 13 | 39 | 35 | 33 | | | |

Measurements were also made of critical micelle concentration (cmc) for three of these ACS products. The product in example 8 showed a cmc of 0.05% w, while that in example 9 exhibited a cmc of 0.01% w. A mixture of the products of examples 10 and 11 had a cmc of 0.01% w.

EXAMPLES 14–16 AND COMPARATIVE EXPERIMENTS A–E

Detergency performance evaluations.

Three ACS surfactants (one derived from reaction of a linear $C_{12}$-alkenyl substituted ASA with a sodium N-methyl taurine salt, the second derived from reaction of a iso-$C_{16}$-alkenyl substituted ASA with sodium N-methyl taurine salt, and the third derived from reaction of a linear $C_{12}$-alkenyl substituted ASA with sodium isethionate) were evaluated for their performance in liquid laundry detergent formulations according to this invention. These ACS components were evaluated in formulations according to the invention containing a conventional nonionic surfactant, i.e., a NEODOL Alcohol Ethoxylate (trademark of and sold by Shell Chemical Company) characterized as the addition product of an average of 9 mols of ethylene oxide to a mixture of substantially linear, primary $C_{12}$–$C_{15}$ alcohols, designated "N25-9". For comparative purposes, these same ACS surfactants were evaluated in formulations without the nonionic surfactant component.

The detergency evaluations were conducted using standard radiotracer techniques to determine soil removal from fabrics. For each test, two soiled fabric swatches (permanent press 65% polyester/35% cotton; 4"×4") were washed and hand rinsed. Wash and rinse waters were combined for radiotracer counting to measure oily soil removal. Radiotracer countings of the washed swatches were made to determine clay removal.

For example 14, a formulation was prepared containing 22.5% w of N25-9 and 7.5% w of the $C_{12}$-ASA-taurine product (30% w total surfactant), 3% w triethanolamine, and the balance water. This formulation was a stable, single-phase liquid without the addition of a solvent or hydrotrope. The formulation was applied at a 1.0 gram per liter concentration in the wash water of each detergency performance test. $CaCl_2$ and $MgCl_2$ in a 3:2 molar ratio were added to the (previously deionized) wash water to simulate 150 ppm water hardness, calculated as $CaCO_3$. The fabric swatches were washed for 10 minutes at 40° C. and under a stirring speed of 100 rpm. The performance of this formulation was tested for the removal of both a double-radiolabeled multisebum soil (12.5% w cetane - $^3H$ labeled, 12.5% w squalane - $^3H$ labeled, 10.0% w tristearin - $^3H$ labeled, 20.0% w arachis (peanut) oil - unlabeled, 7.0% cholesterol - $^{14}C$ labeled, 8.0% w octadecanol $^{14}C$ labeled, 15.0% w oleic acid - $^{14}C$ labeled, 15.0% w stearic acid - $^{14}C$ labeled) and a radio-labeled particulate clay soil (Europium 151 irridiated USpact 6 kaolinite clay). This test resulted in removal of 46% of the multisebum soil and 33% of the clay soil.

For comparative experiment A, the procedures of example 14 were repeated, using a formulation containing 30% w of the $C_{12}$-ASA-taurine surfactant and omitting the N25-9 nonionic surfactant. This comparative test resulted in removal of only 17% of the multisebum soil and 16% of the clay soil.

For comparative experiment B, the procedures of example 14 were repeated, using a formulation containing 30% w of the N25-9 nonionic surfactant and omitting the $C_{12}$-ASA-taurine component. The wash test resulted in removal of 49% of the multisebum soil and 30% of the clay soil.

Example 15 was carried out in the same manner as example 14 except for the substitution of 7.5% of the iso-$C_{16}$-ASA-taurine for the $C_{12}$-ASA-taurine surfactant. This formulation removed of 51% of the multisebum soil and 32% of the clay soil.

For comparative experiment C, the procedures of example 15 were repeated, using a formulation containing 30% w of the iso-$C_{16}$-ASA-taurine surfactant and omitting the N25-9 nonionic surfactant. This comparative test resulted in removal of only 34% of the multisebum soil and 29% of the clay soil.

Example 16 was carried out in the same manner as example 14, except for the substitution of 7.5% of the $C_{12}$ -ASA-isethionate for the $C_{12}$-ASA-taurine surfactant. The resulting formulation removed 48% of the multisebum soil and 32% of the clay soil.

For comparative experiment D, the procedures of example 16 were repeated, using a formulation containing 30% w of the $C_{12}$-ASA-isethionate surfactant and omitting the N25-9 nonionic surfactant. This comparative test resulted in removal of 42% of the multisebum soil and 32% of the clay soil.

In a comparative experiment E, the procedures of examples 14–16 were repeated, using a formulation containing 22.5% w of N25-9 and 7.5% w of a linear $C_{12}$-alkyl substituted benzene sulfonate anionic surfantant (30% w total surfactant), 3% w triethanolamine, and the balance water. The detergency test of this formulation resulted in removal of 44% w of the multisebum soil and 33% w of the clay soil.

EXAMPLES 17 AND 18, AND COMPARATIVE EXPERIMENTS F AND G.

Insensivity of the ACS component to water hardness.

One advantage of the formulation of the present invention is its tolerance to calcium ions in the wash water solution. Anionic surfactants in detergent formulations are generally known to be subject to precipitation from wash water solutions containing hard water ions, e.g., magnesium and particularly calcium. The tolerance of the present formulation to calcium ions in wash solutions is attributable to the tolerance of its anionic ACS component and the capability of that component to function as a detergent builder.

Sensitivity of two ACS compounds (one derived from reaction between a linear $C_{14}$-alkenyl substituted ASA and sodium N-methyl taurine salt and the other derived from reaction between a linear $C_{14}$-alkenyl substituted ASA and sodium isethionate) to calcium ions was determined by titration of test solutions of each of the compounds with calcium chloride, while monitoring light transmittance of the solution to determine turbidity resulting from precipitation of ACS salts. The measurements were carried out using a Brinkmann PC-800 dipping probe colorimeter, combined with a nonaerating stirrer. Test solutions were prepared at a concentration of 2 millimol ACS surfactant per liter with pH adjusted to 10 by addition of dilute NaOH. During the test, the solution was stirred at 2500 rpm and temperature was maintained at 40° C. Calcium ion addition rate was 4 millimols per hour.

Results of the addition of up to a total of 2 millimol per liter of calcium ions are presented in the following table. Also shown in the table are the results of two comparative tests (comparative experiments F and G) of the sensitivity of other anionic surfactants (one a linear $C_{12}$-alkyl substituted benzene sulfonate, "$C_{12}$-LAS", and the other a coconut fatty acid) to calcium ions in the same test. Results are reported in terms of % turbidity (calculated as 100% minus % of light transmittance.)

The results of calcium sensitivity tests were found to be influenced by the presence of reactants, particularly alkenyl succinic anhydride, in the ACS product mixtures used. (Alkenyl succinic anhydrides were observed to be very intolerant to calcium ions.) The $C_{14}$-ASA-taurine product tested in these Examples had an ACS concentration of about 83% w. The $C_{14}$-ASA-isethionate product had an ACS concentration of about 85% w.

| Example/ Comparative Experiment | Surfactant | Millimols Calcium Ion Per Liter | % Turbidity |
|---|---|---|---|
| 17 | $C_{14}$-ASA-taurine | 0.2 | 0 |
| | | 0.4 | 0 |
| | | 0.6 | 1 |
| | | 0.8 | 2 |
| | | 1.0 | 9 |
| | | 1.2 | 13 |
| | | 1.6 | 20 |
| | | 2.0 | 26 |
| | | 2.8 | 39 |
| 18 | $C_{14}$-ASA-isethionate | 0.2 | 0 |
| | | 0.8 | 0 |
| | | 1.0 | 0 |
| | | 1.6 | 0 |
| | | 2.0 | 8 |
| | | 2.8 | 18 |
| F | $C_{12}$-LAS | 0.6 | 2 |
| | | 0.8 | 14 |
| | | 1.0 | 27 |
| | | 1.4 | 42 |
| | | 2.0 | 67 |
| | | 2.6 | 88 |
| | | 3.0 | 94 |
| G | coconut fatty acid | 0.2 | 40 |
| | | 0.4 | 73 |
| | | 0.6 | 92 |
| | | 0.8 | 100 |
| | | 1.0 | 100 |

EXAMPLE 19

Foam tests

This example describes tests made of the foam properties of ACS compounds in aqueous (deionized water) solution. For these tests, solutions having an ACS surfactant concentration of either 0.1% w or 0.01% w were introduced into a dynamic spray foam test apparatus equipped with a cylinder for containing the solution and the foam, a pump to circulate solution from the bottom of the cylinder to the air space above the foam level at the top of the cylinder, a spray nozzle through which the circulating solution is sprayed into the air space, and a heating element to maintain constant liquid solution temperature (40° C). Measurements were made of the height of foam above the liquid solution surface in the cylinder, after 10 minutes.

The results of these tests, presented in the following table, illustrate that the ACS compounds are low-foaming surfactants. The comparative data also presented illustrates that although the ACS compounds are anionic surfactants, their foam generation properties more closely resemble those of low-foaming nonionic surfactants such as N25-9 than they do those of higher-foaming anionic surfactants such as $C_{12}$-LAS. Application of ACS compounds in low-foaming laundry frormulations is considered surprising in light of prior art teaching of the lather-inducing properties of ACS compounds.

| Surfactant | Concentration | Foam Height (cm) |
|---|---|---|
| $C_{12}$-ASA-isethionate | 0.01% w | 0 |
| $C_{14}$-ASA-isethionate | 0.01 | 13 |
| $C_{16}$-ASA-isethionate | 0.01 | 31 |
| $C_{18}$-ASA-isethionate | 0.01 | 28 |
| $C_{12}$-ASA-taurine | 0.01% w | 0 |
| $C_{14}$-ASA-taurine | 0.01 | 6 |
| iso-$C_{16}$-ASA-taurine | 0.01 | 1.5 |
| $C_{16}$-ASA-taurine | 0.01 | 10 |
| $C_{18}$-ASA-taurine | 0.01 | 22 |
| $C_{12}$-ASA-isethionate | 0.1% w | 0 |
| $C_{14}$-ASA-isethionate | 0.1 | 39 |
| $C_{16}$-ASA-isethionate | 0.1 | 55 |
| $C_{18}$-ASA-isethionate | 0.1 | 50 |
| $C_{12}$-ASA-taurine | 0.1% w | 0 |
| $C_{14}$-ASA-taurine | 0.1 | 36 |
| iso-$C_{16}$-ASA-taurine | 0.1 | 20 |
| $C_{16}$-ASA-taurine | 0.1 | 47 |
| $C_{18}$-ASA-taurine | 0.1 | 51 |
| $C_{12}$-LAS | 0.01% w | 47 |
| $C_{12}$-LAS | 0.1 | 57 |
| N25-9 | 0.1% w | 47 |

WE CLAIM AS OUR INVENTION:

1. A nonionic surfactant based, stable single-phase, built, biodegradable, low-foaming liquid laundry detergent formulation, which consists essentially of (a) between about 20 and about 30 percent by weight of one or more nonionic surfactants selected from the group consisting of alcohol ethoxylate surfactants and alkyl-substituted phenol ethoxylate surfactants having an average of between about 4 and 12 ethylene oxide units per ethoxylate molecule, (b) between about 1 and about 10 percent by weight of one or more carboxysulfonate compounds of the formula $$XOOC-\overset{(R^1)_p}{\overset{|}{CH(H)_q}}-\overset{(R^1)_q}{\overset{|}{CH(H)_p}}-\overset{O}{\overset{\|}{C}}-Z-CH_2-CH_2-SO3M, \quad (I)$$

wherein $R^1$ is selected from the group consisting of alkenyl and alkyl groups having carbon numbers in the range of from about 9 to 18, p is either 0 or 1, q is o when p is 1 and q is 1 when p is 0, X is selected from the group consisting of a hydrogen atom and an M cation, Z is selected from the group consisting of an oxygen atom and —N($R^2$)—groups wherein $R^2$ is $C_1$ to $C_4$ alkyl, and each M is a salt forming cation, with the further provision that the sum of components (a) and (b) is between about 21 and about 35 percent by weight, (c) between 0 and about 20 percent by weight of a detergent builder, (d) between about 2 and about 8 percent by weight of triethanol amine, and (e) water.

2. The formulation of claim 1, wherein the one or more nonionic surfactants are alkanol ethoxylate surfactants.

3. The formulation of claim 1, % wherein component (b) comprises one or more carboxysulfonate compounds wherein $R^1$ represents an alkenyl group having a carbon number in the range from about 12 to about 18.

4. The formulation of claim 3, wherein component (b) comprises one or more alkenyl carboxysulfonate compounds wherein Z represents an oxygen atom.

5. The formulation of claim 3, wherein component (b) comprises one or more alkenyl carboxysulfonate compounds wherein Z represents a —N($R^2$)—group.

6. The formulation of claim 2, wherein component (b) comprises one or more carboxysulfonate compounds wherein $R^1$ represents an alkenyl or alkyl group having a carbon number in the range from about 12 to about 18.

7. The formulation of claim 6, wherein component (b) comprises one or more alkenyl carboxysulfonate compounds wherein Z represents an oxygen atom.

8. The formulation of claim 6, wherein component (b) comprises one or more alkenyl carboxysulfonate compounds wherein Z represents a —N($R^2$)—group.

9. The formulation of claim 1, wherein the one or more carboxysulfonate compounds are a mixture of compounds wherein $R^1$ represents an alkenyl or alkyl group having a carbon number in the range from about 12 to about 18 and X is a hydrogen atom.

10. A nonionic surfactant based, stable single-phase, biodegradable, low-foaming liquid laundry detergent formulation, which consists essentially of (a) between about 23 and 28 percent by weight of one or more nonionic surfactants selected from the group consisting of alcohol ethoxylate surfactants and alkyl-substituted phenol ethoxylate surfactants having an average of between about 5 and 10 ethylene oxide units per ethoxylate molecule, (b) between about 2 and 8 percent by weight of one or more carboxysulfonate compounds of the formula $$XOOC-\overset{(R^1)_p}{\overset{|}{C}}H(H)_q-\overset{(R^1)_q}{\overset{|}{C}}H(H)_p-\overset{O}{\overset{\|}{C}}-Z-CH_2-CH_2-SO_3M, \quad (I)$$

wherein $R^1$ represents an alkenyl or alkyl group having a carbon number in the range of from about 12 to 18, p is either 0 or 1, q is 0 when p is 1 and q is 1 when p is 0, X is selected from the group consisting of a hydrogen atom and an M cation, Z is selected from the group consisting of an oxygen atom and a group —N($R^2$)— wherein $R^2$ is particularly $C_1$ to $C_4$ alkyl, and each M is a salt forming cation, with the further provision that the sum of components (a) and (b) is between about 25 and about 35 percent by weight, (c) between about 2 and 8 percent by weight of triethanolamine, and (d) between about 57 and 73 percent by weight of water.

11. The formulation of claim 10, wherein the one or more nonionic surfactants are alkanol ethoxylate surfactants derived from alkanols in the carbon number range from about 10 to 16 and having an average of between about 5 and 9 ethylene oxide units per ethoxylate molecule.

12. The formulation of claim 11, wherein the alkanols are predominantly linear, primary alkanols.

13. The formulation of claim 12, wherein the alkenyl and alkyl groups of the carboxysulfonate compounds are predominantly linear.

14. The formulation of claim 11, wherein component (b) comprises one or more carboxysulfonate compounds wherein Z represents an oxygen atom.

15. The formulation of claim 11, wherein component (b) comprises one or more carboxysulfonate compounds wherein Z represents a —N($R^2$)—group.

16. The formulation of claim 14, wherein the one or more carboxysulfonate compounds are a mixture of compounds wherein $R^1$ represents an alkenyl or alkyl qroup having a carbon number in the range from about 12 to about 18 and X is a hydrogen atom.

17. The formulation of claim 15, wherein the one or more carboxysulfonate compounds are a mixture of compounds wherein $R^1$ represents an alkenyl or alkyl group having a carbon number in the range from about 12 to about 18 and X is a hydrogen atom.

18. The formulation of claim 10, wherein component (b) comprises one or more carboxysulfonate compounds wherein Z represents an oxygen atom.

19. The formulation of claim 10, wherein component (b) comprises one or more carboxysulfonate compounds wherein Z represents a —N($R^2$)—group.

20. The formulation of claim 18, wherein the one or more carboxysulfonate compounds are a mixture of compounds wherein $R^1$ represents an alkenyl or alkyl group having a carbon number in the range from about 12 to about 18 and X is a hydrogen atom.

21. The formulation of claim 19, wherein the one or more carboxysulfonate compounds are a mixture of compounds wherein $R^1$ represents an alkenyl or alkyl group having a carbon number in the range from about 12 to about 18 and X is a hydrogen atom.

* * * * *